US005863101A

United States Patent [19]

Seear

[11] Patent Number: 5,863,101

[45] Date of Patent: Jan. 26, 1999

[54] AUGER MINING MACHINE AND MINE LAUNCH DEVICE

[76] Inventor: Peter Kenneth Seear, 231 Evergreen Dr., Franklin, Pa. 16323

[21] Appl. No.: 818,658

[22] Filed: Mar. 14, 1997

[30] Foreign Application Priority Data

Mar. 28, 1996 [AU] Australia ..... PN8983
Apr. 2, 1996 [AU] Australia ..... PN9073

[51] Int. Cl.[6] ..... E21D 9/10; E21C 35/08

[52] U.S. Cl. ..... 299/68; 175/62; 299/57

[58] Field of Search ..... 299/31, 33, 56, 299/57, 59, 64, 67, 68; 175/62

[56] References Cited

U.S. PATENT DOCUMENTS 3,767,836 10/1973 Geis et al ..... 175/62 X
3,945,443 3/1976 Barnes ..... 175/62 X
4,655,493 4/1987 Sumi ..... 299/31 X
4,818,026 4/1989 Yamazaki et al. ..... 299/56

FOREIGN PATENT DOCUMENTS 432280 8/1975 Russian Federation ..... 299/57

*Primary Examiner*—David J. Bagnell
*Attorney, Agent, or Firm*—Ladas & Parry

[57] ABSTRACT

An auger mining machine (10) including a cutter head (11) from which there extends an auger train (12) consisting of a plurality of axially aligned auger modules (13). The cutting head (11) includes a cutting assembly (21) driven by electric motors (38). The cutting assembly (21) is supported on a housing (22) for movement relative thereto to move the cutting assembly (21) into material being mined. There is further provided a launch vehicle (120) from which the auger train (12) extends. Said launch vehicle (120) is provided with a motor (113) to drive the auger train. The launch vehicle (120) has cylinders (123) which engage a mine face to retain the launch vehicle (120) in a desired position.

21 Claims, 9 Drawing Sheets

AUGER MINING MACHINE AND MINE LAUNCH DEVICE

TECHNICAL FIELD

The present invention relates to mining machines and more particularly but not exclusively to auger highwall mining machines used to mine coal.

BACKGROUND OF THE INVENTION

Auger mining machines employed in the coal industry use a cutting head at the end of an auger string. The rotational cutting force as well as the axial thrust force is generated at the launch vehicle and transmitted via the auger string. Due to friction losses along the length of the auger string hole depths are limited. More particularly, available cutting and conveying power decreases as the hole depth increases. Furthermore, the effectiveness of augering has been limited by the lack of both lateral and vertical "in seam" guidance systems.

Highwall mining systems generate a reaction force against a high wall face when the combined retractive forces exerted by traction jacks exceed the frictional drag imposed by the launch vehicles mass and the prevailing coefficient of friction between the ground engaging underside of the launch vehicle and the supporting ground surface.

Previous highwall and auger mining systems (including cascading continuous miner types of systems) have limited ability to impose substantial reaction forces due to the limitations in respect of these friction forces generated by the launch vehicle. This inherent weakness has the effect of limiting the mass of conveyors which may be employed in the highwall or auger mining assembly. This directly limits the maximum whole depth which can be mined. To address this shortcoming it is not uncommon for vehicles to provide "pull-out" assistance. Typically the vehicles are cat track bulldozers and similar type wheeled vehicles.

OBJECT OF THE INVENTION

It is the object of the present invention to overcome or substantially ameliorate the above disadvantages.

SUMMARY OF THE INVENTION

There is disclosed herein an auger mining machine comprising:

a cutting head including a housing, a cutting assembly supported on a leading portion of the housing, said assembly including at least one cutter, and motor means mounted within the housing to cause rotation of the cutter; and an auger train extending rearwardly from the cutting head to transport material mined away from the cutting head.

Preferably, the cutting assembly is movably mounted on the housing for relative movement in a direction generally parallel the longitudinal axis of the mining machine.

There is further disclosed herein a mine launch device comprising:

a base;

motor means mounted on the base for coupling to and to drive a mining assembly to extend into a layer of material to be mined; and a plurality of thrust reaction cylinders mounted on the base and to engage a face from which the layer extends to aid and retain the device in position relative to the layer during a mining operation.

BRIEF DESCRIPTION OF THE DRAWINGS

A preferred form of the present invention will now be described by way of example with reference to the accompanying drawings wherein.

DESCRIPTION OF THE PRIOR ART

Figure 10:
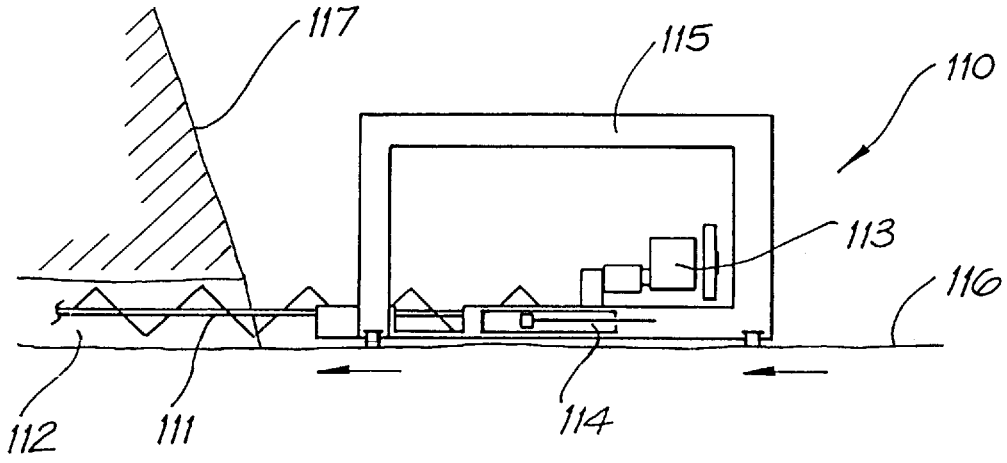
Figure 11:
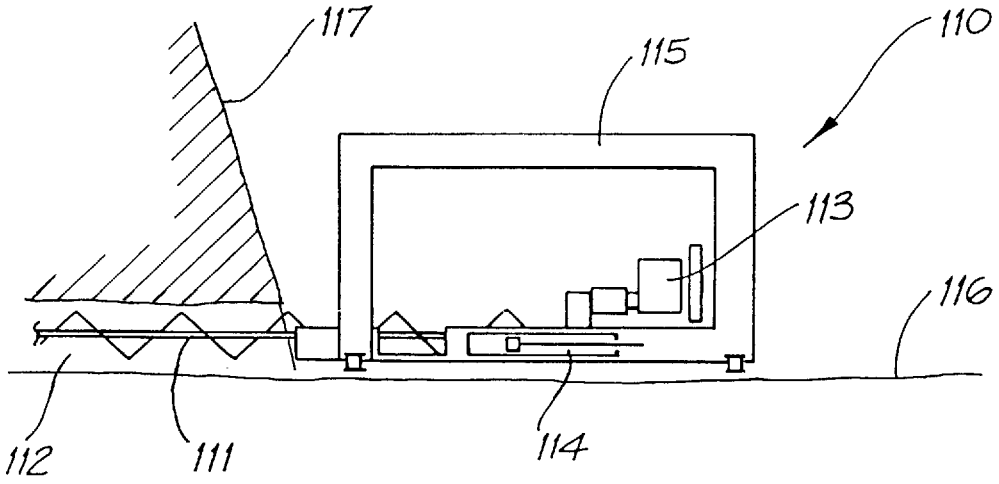

In FIGS. 10 and 11 of the accompanying drawings there is schematically depicted a launch vehicle 110. In this instance the launch vehicle 110 is attached to and drives an auger device 111 which projects into a seam or layer 112 being mined. The auger 111 is driven by means of a motor assembly 113, while there is further provided a hydraulic cylinder assembly 114 to apply a force to the auger 111. The motor assembly 113 and other pieces of apparatus are mounted on a frame 115. The frame 115 rests on the ground surface 116 and is merely retained in position by frictional engagement between the frame 115 and surface 116. If the frictional forces existing between the frame 115 and surface 116 are exceeded, the frame 115 can be dragged into engagement with the face 117 (as seen in FIG. 11).

DETAILED DESCRIPTION OF THE PREFERRED EMBODIMENT

In FIGS. 1 to 8 of the accompanying drawings there is schematically depicted an auger mining machine 10. The mining machine 10 includes a cutting head 11 from which there rearwardly extends an auger train 12 consisting of a plurality of axially aligned auger modules 13. The auger modules 13 extend between the cutting head 11 and a launch vehicle 14.

The launch vehicle 14 would consist of a main frame 15 which supported one or more hydraulic rams 16. The rams 16 would engage the last module 13 of the train 12 so as to apply an axial force thereto. When the train 12 is being advanced, it would be in compression. When the train 12 is being withdrawn, the train 12 would be in tension.

Each of the modules 13 would include an outer casing housing a pair of rotatably supported auger lengths. The auger lengths of adjacent modules 13 would be drivingly connected, with the launch vehicle 14 being provided with at least one motor to cause rotation of the auger strings. The auger strings withdraw coal 17 that is mined and deliver it to a conveyor or other transport means.

The cutting head 11 advances down the coal seam along the longitudinal axis of the mining machine and creates a tunnel 18 along which the train 12 passes. The tunnel 18 terminates with an aperture 19 in a face 20 adjacent which the vehicle 14 is positioned.

The cutting head 11 is provided with a cutting assembly 21 which is movably supported by the housing 22 of the cutting head 11. The cutting assembly 21 is movable longitudinally relative to the housing 22. More particularly, the cutting assembly 21 would include a pair of rotatably driven cutting drums 23 provided with cutting teeth 24. Mounted between the drums 23 are core breakers 37.

Extending longitudinally through the housing 22 and rearwardly from the drums 23 are passages 36 which receive augers. The augers extending through the passages 36 and are aligned with the augers of the modules 13, with each of the modules 13 including an outer housing encompassing the augers. The augers are linked so as to provide two continuous auger strings which are driven from the vehicle 14. Accordingly, as coal is cut by the cutting assembly 21, it is transported rearwardly out through the aperture 19 via the auger strings.

The cutting assembly 21 is movably supported by the housing 22. More particularly, the assembly 21 is movable in the longitudinal direction relative to the housing 22 by means of hydraulic rams 25. In operation, the assembly 21 starts from the position shown in FIG. 1. Thereafter, it is moved forward so as to cut into the coal 17. When it has reached its forward limit, the housing 22 is advanced to adjacent the rear of the assembly 21. By having the cutting assembly 21 movable relative to the housing 22, the axial thrust delivered to the cutting assembly 21 can be maximised. Thus the cutting head 11 is advanced in an intermittent manner as is the housing 22.

Figure 1:
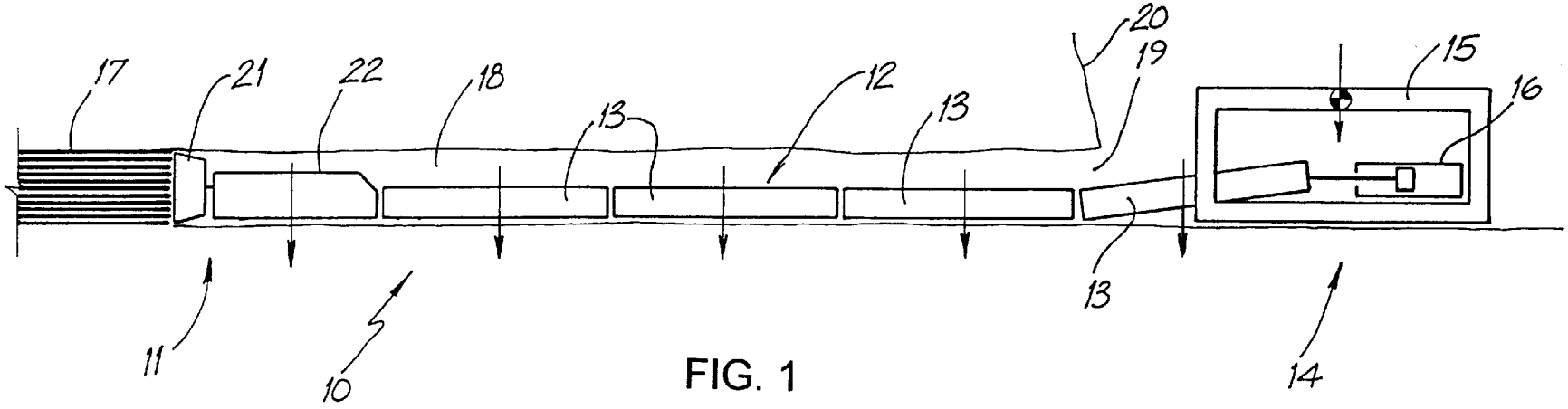
FIG. 1 is a schematic side elevation of an auger mining machine with the cutter drums retracted.
Figure 2:
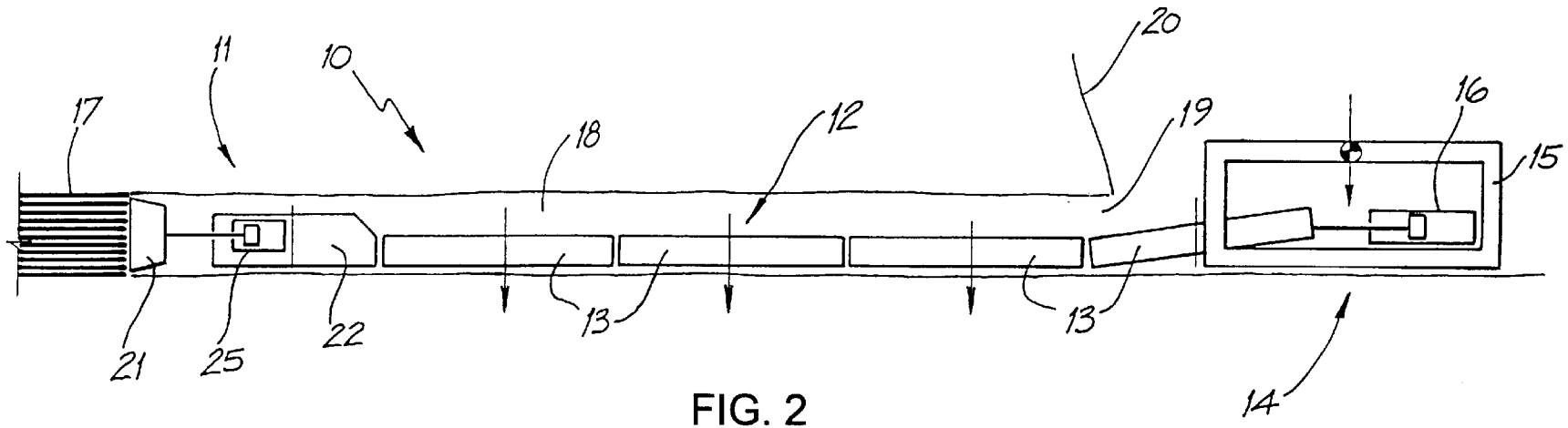
FIG. 2 is a schematic side elevation of the machine of FIG. 1 with the cutter drums extended.
Figure 3:
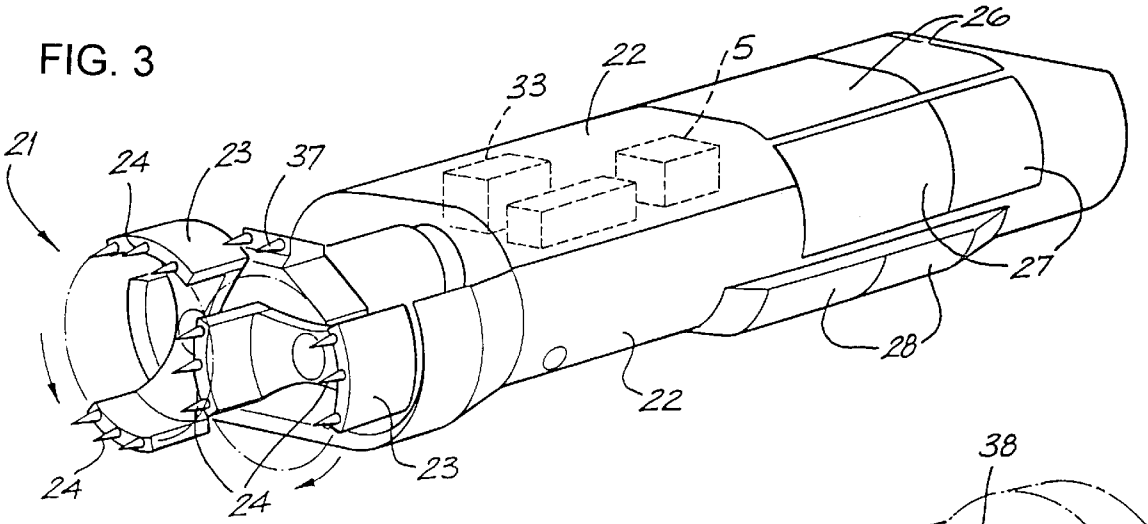
FIG. 3 is a schematic perspective view of the cutting head of the machine of FIG. 1.
Figure 4:
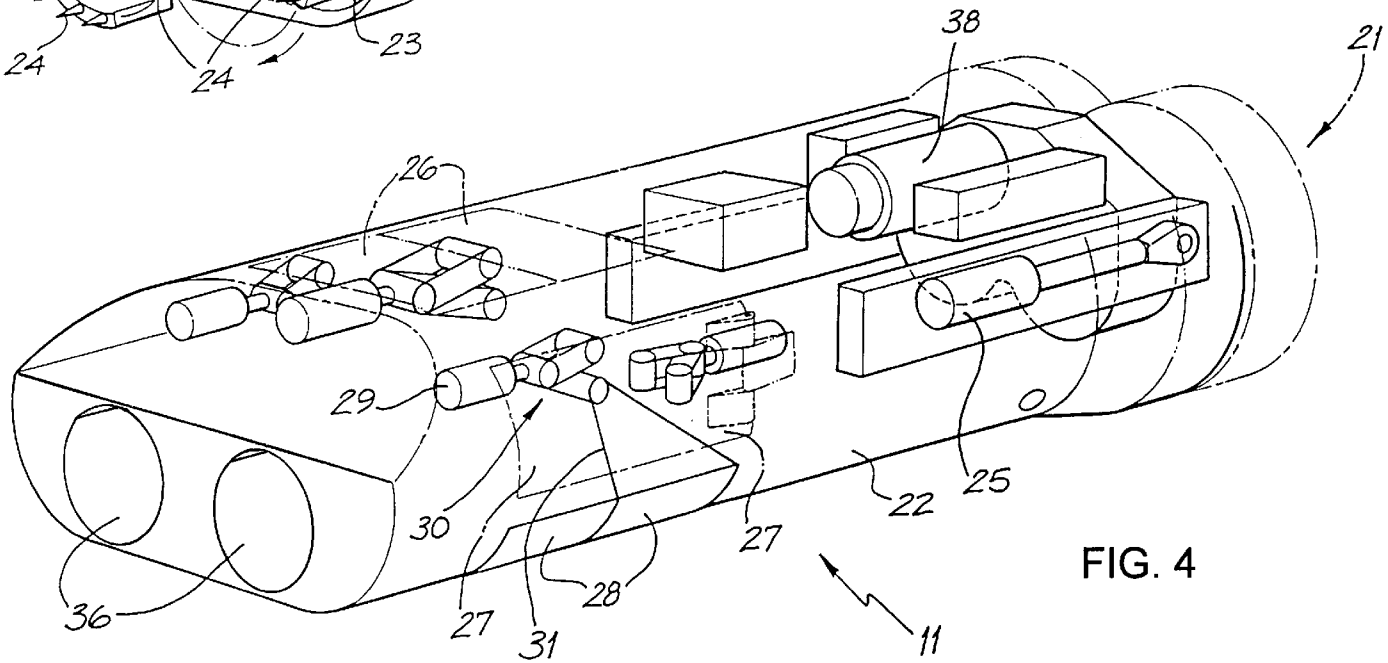
FIG. 4 is a schematic perspective view of the cutting head of FIG. 3.
Figure 5:
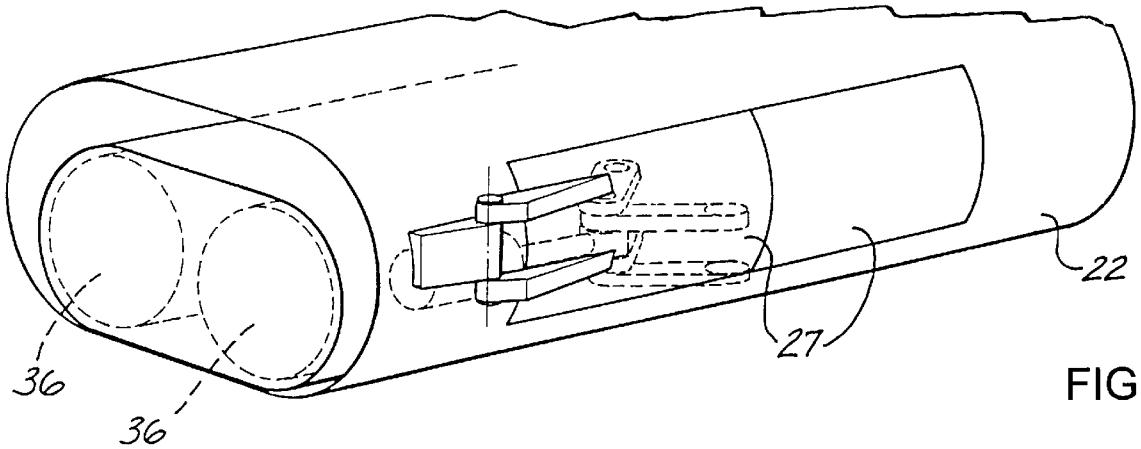
FIG. 5 is a schematic perspective view of a portion of the cutting head of FIG. 4, together with the steering mechanism.
Figure 6:
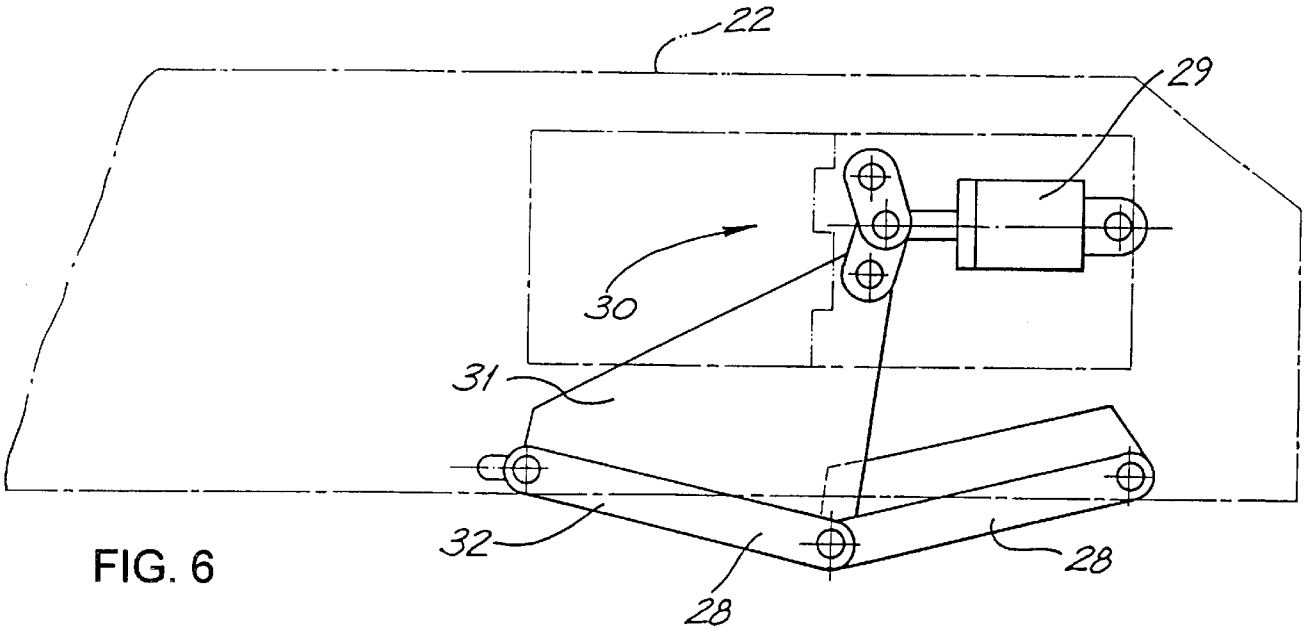
FIG. 6 is a schematic side elevation of a portion of the cutting head of FIG. 2.

It should be appreciated that the cutting assembly 21 has a height greater than the housing 22 and each of the modules 13 so as to provide head clearance thereabove. Also as mentioned above, the cutting assembly 21 is driven by a motor 38 mounted in the housing 22. By having such an arrangement the forces applied to the train 12 are reduced since the train 12 no longer transmits the torque required for the cutting head 21. The cutting head 11 has steering surfaces 26, 27 and 28. The surfaces 26 and 28 would guide the cutting head 11 in a vertical plane, while the surfaces 27 (located on both sides of the housing 22) would be provided for lateral control. The surfaces 28 could typically be controlled by means of a ram 29 acting on a toggle mechanism 30. The toggle mechanism 30 acts on a link 31 extending to a steering member 32 providing the surface 28. The surfaces 26, 27 and 28 are located at a position spaced from the forward end of the housing 22 and are closer to the rear end of the housing 22, as best seen in FIGS. 3 and 4, so as to engage the surfaces of the tunnel 18 to direct the cutting head 11. Steering is aided by the use of a ring laser gyro 33. There would also be provided a gamma sensing crystal device 5 to aid in determining the depth of coal above the cutting head 11.

Each of the surfaces 26 and 27 would be provided with a toggle mechanism and associated hydraulic ram in a similar manner to the surfaces 28.

Figure 7:
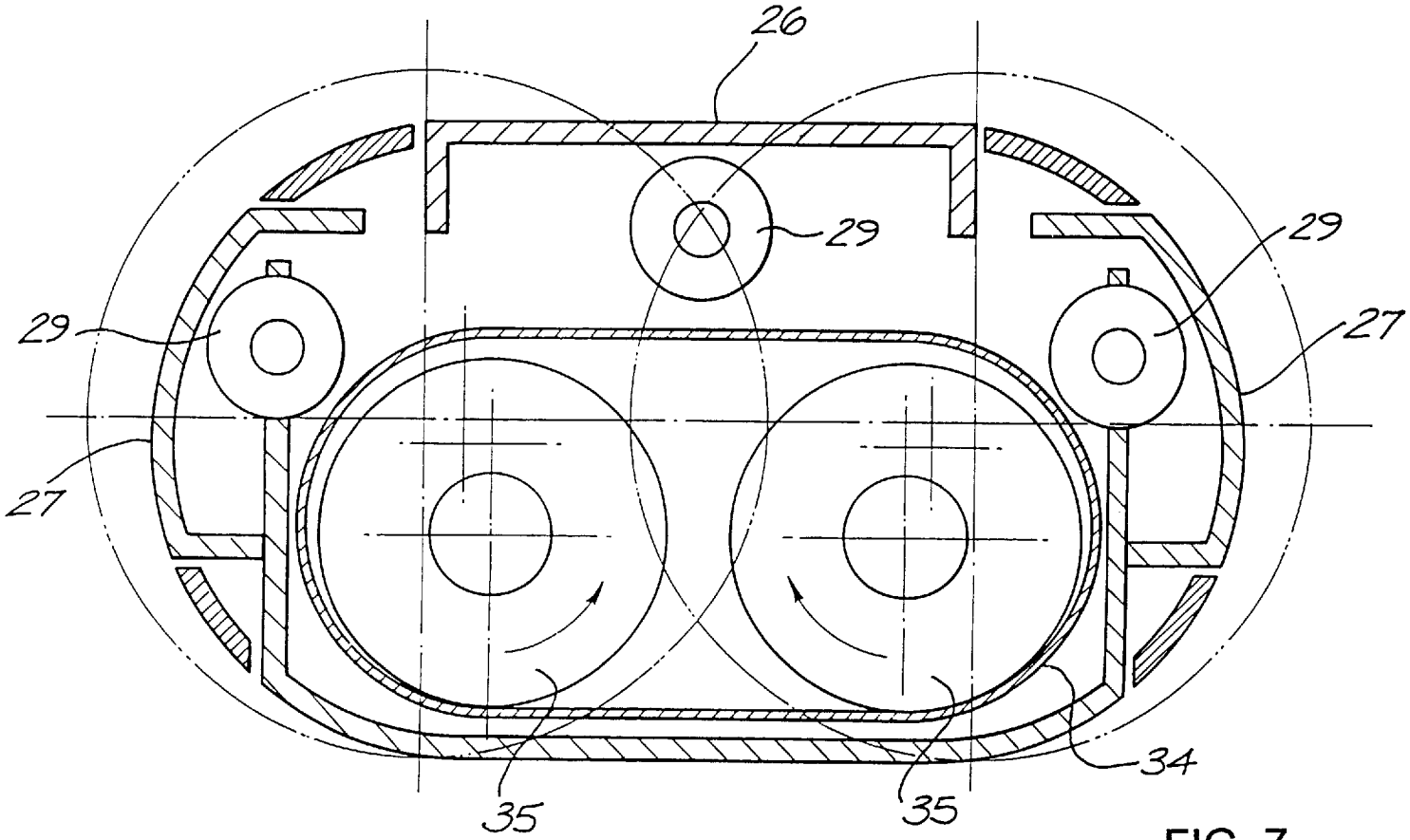
FIG. 7 is a schematic sectioned end elevation of the cutting head of FIG. 3.

As best seen in FIG. 7, the housing 22 is provided with a tubular member 34 which extends rearwardly from the cutting assembly 21 and receives rotatably driven augers 35 which extend to the passages 36. It should be appreciated that the augers 35 rotate in opposite directions as do the cutting drums 23.

Preferably the cutting assembly 21 would be driven by an electric motor 38. Cabling to deliver electric power to the motor 38 would extend down through the auger train 12 from the vehicle 14.

The above described preferred embodiment provides distinctive advantages. Firstly, the tunnel 18 can extend to greater depths relative to previously known machines. The cutting head may be controlled in respect of direction. Still further, the geometry of the cutting head 21 provides for greater coal recovery and the machine 10 is energy efficient due to the reduction of frictional forces.

Figure 8:
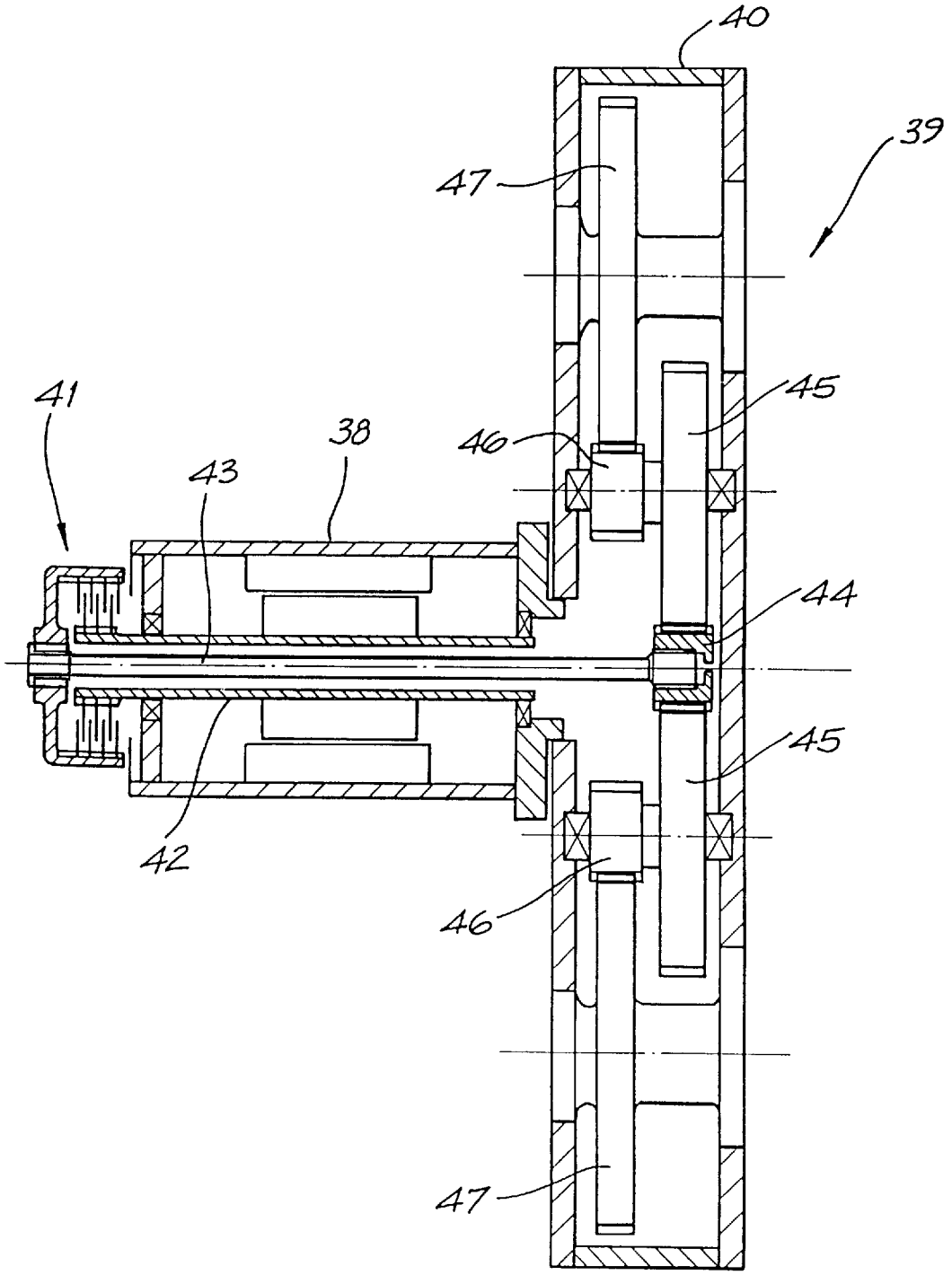
FIG. 8 is a schematic sectioned plan view of an electric drive motor and cutter head gear assembly employed in the machine of FIG. 1.
Figure 9:
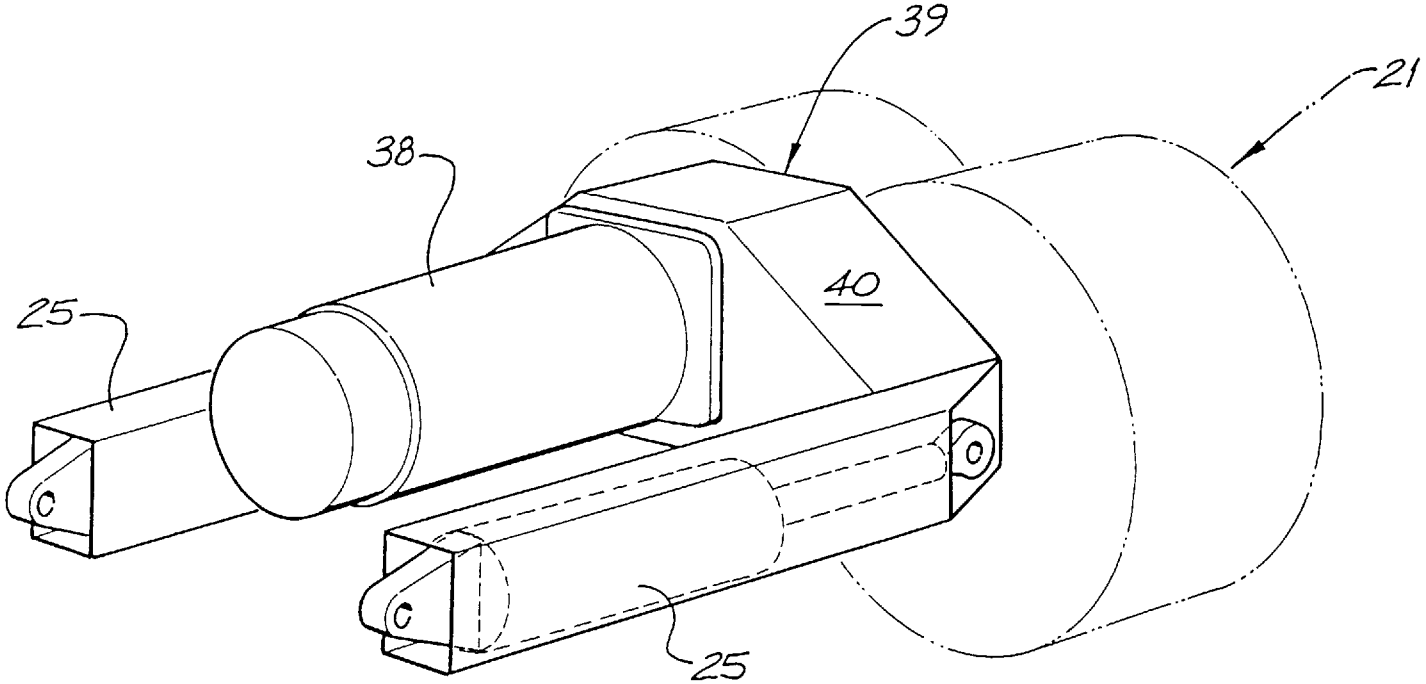
FIG. 9 is a schematic perspective view of the motor and gear assembly of FIG. 8, FIGS. 10 and 11 are schematic side elevations of a previously available mining launch vehicle.

With particular reference to FIGS. 8 and 9, there is illustrated the motor 38 connected to a gear assembly 39. The gear assembly 39 includes a housing 40. Attached to the housing 40 is the motor 38 and a torque limiting clutch 41. The motor 38 drives a hollow shaft 42 extending to the clutch 41. The clutch 41 transmits the torque to an internal shaft 43 extending coaxially through the shaft 42. The shaft 43 drives a pinion gear 44 which drives a pair of gears 45. The gears 45 are attached to gears 46 which in turn drive outer gears 47. The gears 47 are drivingly attached to cutting drums 23.

The above mentioned auger mining machine would be provided with a cutting head guidance system preferably consisting of a ring laser gyro to track and monitor the position of the cutting assembly 21 in three dimensions. Furthermore, a roof coal thickness indicator determines and would display to an operator, the position of the cutting assembly 21 relative to the coal seam. These guidance systems feed position data to the operator, who can make steering corrections to the heading of the cutter assembly 21, via an onboard hydraulic steering system previously discussed, that is directing the cutting head 11 via operation of the steering surfaces 26, 27 and 28.

Preferably, cutting drums 23 of varying diameters could be provided to permit efficient mining of different seam depths while using a single auger conveying machine.

Figure 12:
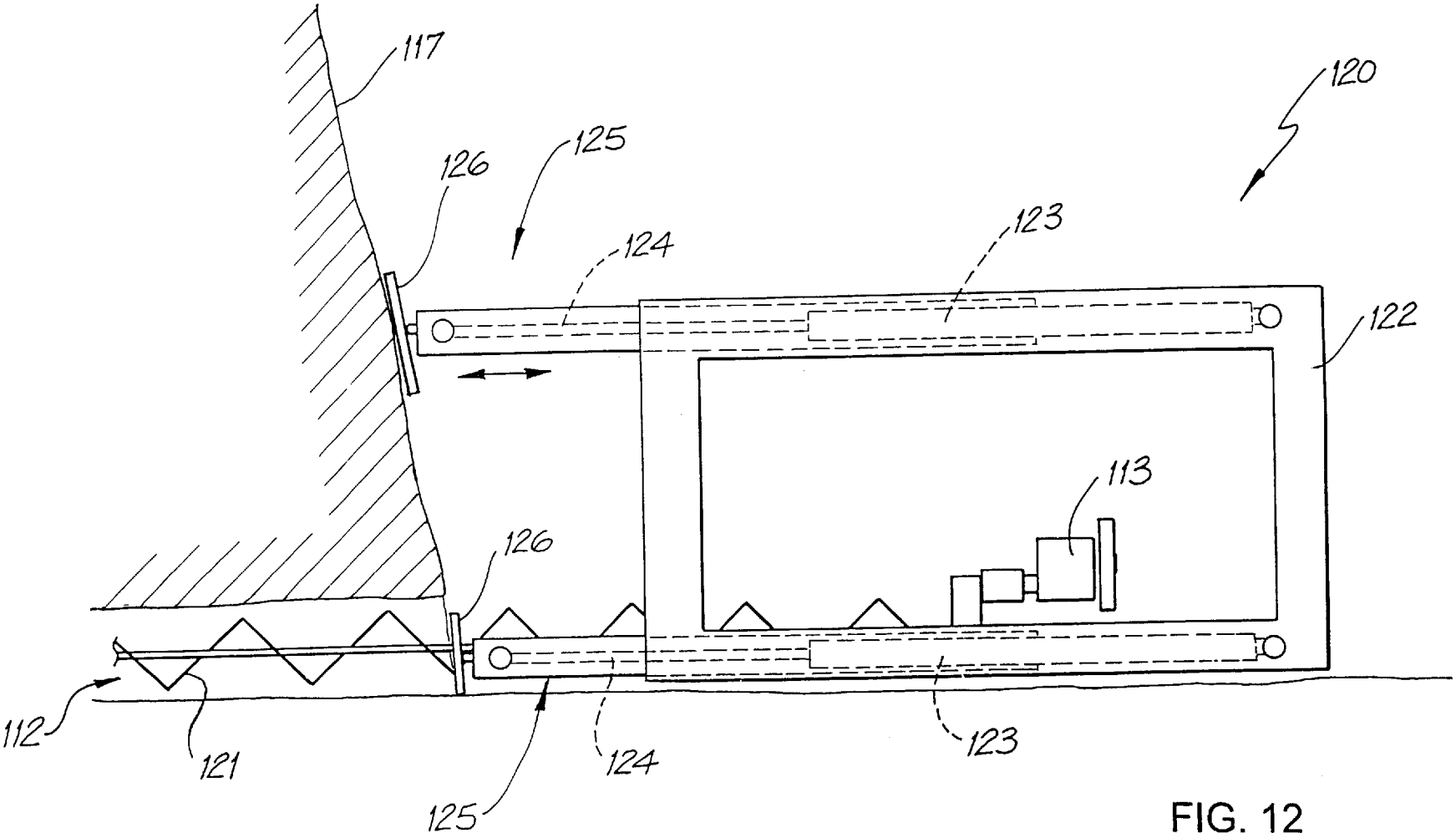
FIG. 12 is a schematic side elevation of a launch vehicle embodying the present invention.
Figure 13:
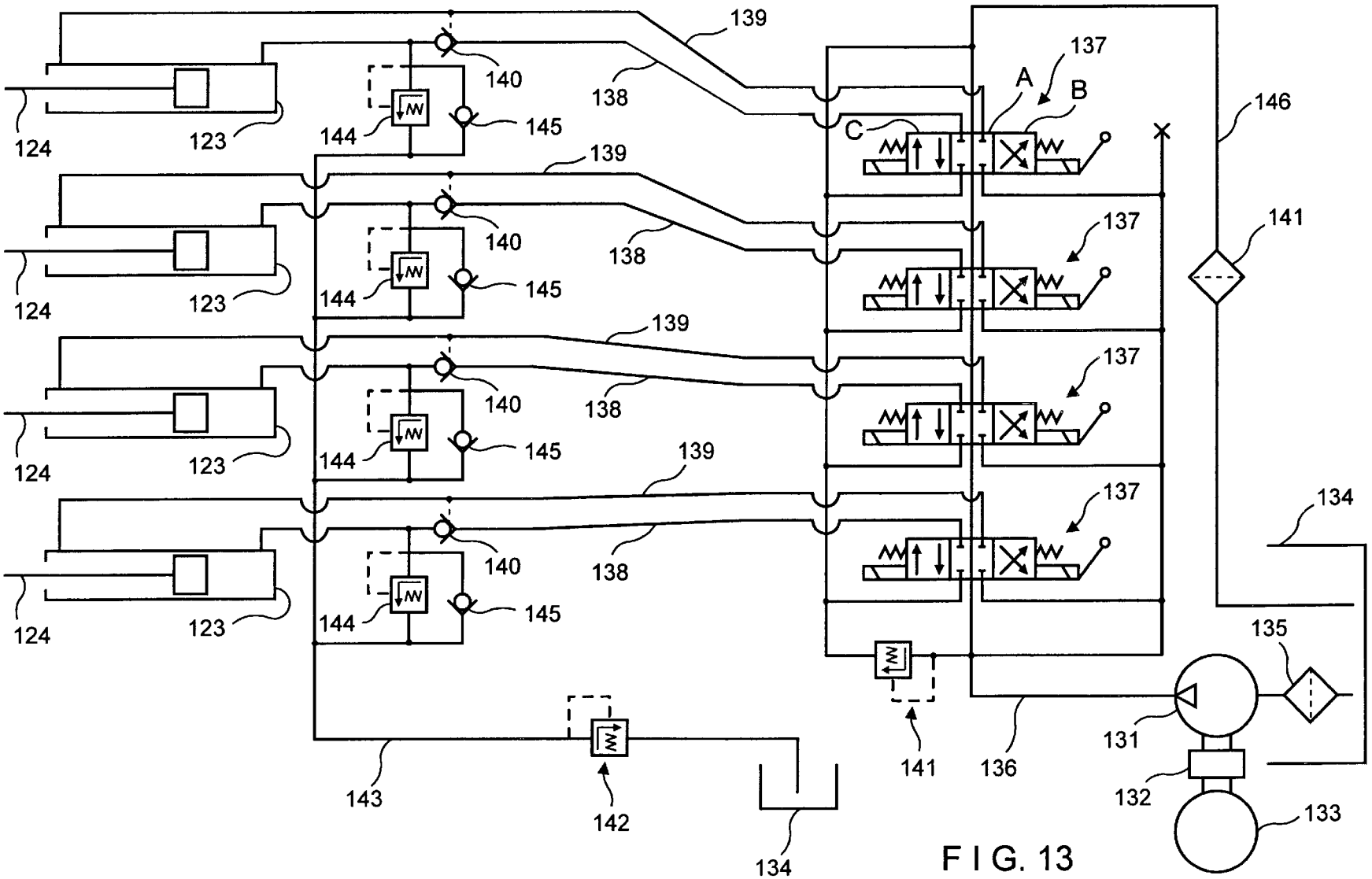
FIG. 13 is a schematic hydraulic circuit to be employed in the launch vehicle of FIG. 12.

In FIGS. 12 and 13 of the accompanying drawings there is schematically depicted a launch device 120 to control and drive a piece of mining apparatus such as the auger 121 shown in FIG. 10 or alternatively a conveyor continuous miner.

The device 120 includes a frame 122 upon which the motor assembly 113 is mounted. As discussed previously, the motor assembly 113 drives the auger 121. Again a hydraulic cylinder would be provided to drive the auger 121 against the surface being mined.

Mounted on the frame 122 is a plurality of hydraulic cylinders 123 from which there extends piston rods 124 forming part of thrust reaction struts 125. In the present embodiment there are four reaction struts 125. However, as little as two reaction struts may be employed. Each of the struts 125 terminates with a pressure plate 126 pivotally attached to the end of the strut 125. The other end of each cylinder 123 is pivotally attached to the frame 122.

In FIG. 13 there is schematically depicted a hydraulic circuit 130 incorporating the cylinders 123. The circuit 130 includes a pump 131 which may be typically a fixed-displacement hydraulic pump. The pump 131 is driven by means of a clutch or coupling 132 driven by a motor 133. The pump 131 also communicates with a reservoir 134 via a filter 135. More particularly, the pump 131 draws hydraulic fluid from the reservoir 134.

Hydraulic fluid under pressure is delivered to the line 136, which line 136 is attached to spool valves 137, each of which is associated with a particular one of the cylinders 123. Each of the spool valves 137 has three operative positions. In the position depicted the hydraulic fluid delivered to the line 136 is returned to the reservoir 134 via the line 146 and filter 141. Accordingly, in this first operative position "A" these cylinders 123 are basically inoperative. In the second position "B" hydraulic fluid under pressure is delivered to the lines 138 so as to cause the piston rods 124 to extend. In the third position "C" hydraulic fluid under pressure is delivered to the lines 139 to cause the piston rods 124 to retract. In the "B" position the lines 134 are connected to the lines 137 and therefore the reservoir 134. In the "C" position the lines 138 are connected to the lines 137 and therefore the reservoir 134. In this regard it should be appreciated that pilot operated check valves 140 permit fluid to flow therethrough when hydraulic fluid under pressure is delivered to the line 139 as the hydraulic fluid in the line 139 causes the check valves 140 to open.

The forces exerted by the cylinders 132 are limited by a single common relief valve 141 which effectively vents hydraulic fluid from the line 136 to the line 146 which leads to the reservoir 134. There is further provided a common relief valve 142 which protects the cylinders 123 from being overloaded. In that regard each of the lines 138 is connected to the line 143 via a pilot operated check valve 144 set to exhaust hydraulic fluid to the line 143 when a predetermined pressure is exceeded. There is also provided check valves 145 which ensure that all cylinders 123 are simultaneously connected to the line 143 should an overload position be encountered. Essentially, the one-way check valves 145 delivers hydraulic fluid to the valves 144 to ensure that they act in unison.

It should be appreciated that the spool valves 137 are operated in unison.

Once the normal traction forces are exceeded, the hydraulic thrust reaction struts 125 are then exposed to the additional forces generated. The reaction forces are evenly distributed amongst the struts 125.

Once a nominal maximum "cracking" pressure of 600–800 psi has been exerted, the cylinders 123 vent through the valves 140. Extension of the piston rods 124 will result from any pressure imbalance if the highwall face 117 yields locally. Extension of the thrust reaction struts 125 results in the cylinders 123 sharing the shifting load equally.

By equalising the forces and providing a reaction thrust equal to or greater than any frictional forces which may be generated by the launch device 120, greater entry depths and improved highwall stability are provided. The safety of the system is also enhanced. Generally this results in greater productivity.

What I claim is:

1. An auger mining machine comprising:

a cutting head including a housing, a cutting assembly supported on a leading portion of the housing, said assembly including at least one cutter, and motor means mounted within the housing to cause rotation of the cutter, steering surfaces movable to engage a mine wall to apply a force generally transverse of the direction of movement of the machine along a longitudinal axis, said steering surfaces being located on the housing so as to be spaced from said leading portion and to be closer to a rear end of said housing;

an auger train extending rearwardly from the cutting head to transport material mined away from the cutting head.

2. The mining machine of claim 1, wherein the cutting assembly includes a pair of cutters which are rotatably driven in opposite directions, by said motor means, about generally parallel axes extending longitudinally of the mining machine.

3. The mining machine of claim 1, wherein the cutting assembly is movably mounted on the housing for relative movement with respect thereto in a direction generally parallel to the longitudinal axis of the mining machine.

4. In combination, a launch device and the mining machine of claim 1, wherein the launch device applies an axial force to the auger train.

5. The combination of claim 4 wherein the launch device comprises:

a base;

motor means mounted on the base and drivingly coupled to the mining machine, which extends into a layer of material to be mined; and a plurality of thrust reaction cylinders mounted on the base for engaging a face from which the layer extends to aid and retain the device in position relative to the layer during a mining operation.

6. The combination of claim 5, further including a hydraulic assembly to deliver hydraulic fluid under pressure to the reaction cylinders, said hydraulic circuit including means to deliver substantially the same hydraulic pressure to each of the cylinders, and a common relief valve to protect the cylinders from being overloaded.

7. The combination of claim 6, wherein each reaction cylinder includes a piston rod, and said hydraulic assembly includes a spool valve associated with each cylinder, with each spool valve having a first, a second and a third operative position, with the first position rendering the associated cylinder inoperative, the second position delivering hydraulic fluid under pressure to the associated cylinder to cause telescopic extension between the cylinder and its associated piston rod, and the third position delivering hydraulic fluid to the associated cylinder to cause telescopic retraction between the cylinder and its associated piston rod.

8. The combination of claim 6 wherein said hydraulic assembly includes a check valve associated with each cylinder to relieve pressure therefrom with the common relief valve communicating with the check valves, said hydraulic assembly further including valves to ensure actuation of all the check valves to ensure that they act in unison.

9. The mining machine of claim 1, wherein said steering surfaces include steering surfaces which guide the mining machine in a generally vertical plane and steering surfaces which provide for lateral control.

10. The mining machine of claim 9, further including at least one auger member mounted within the housing to convey mined material from the cutting assembly, which auger member communicates with the auger train to deliver material thereto.

11. The mining machine of claim 1, which includes a gyro to aid in the steering.

12. A mine launch device comprising:

a base;

motor means mounted on the base for coupling to and to drive a mining machine to extend into a layer of material to be mined; and a plurality of thrust reaction cylinders mounted on the base and to engage a face from which the layer extends to aid and retain the device in position relative to the layer during a mining operation.

13. The mining launch device of claim 12, further including a hydraulic assembly to deliver hydraulic fluid under pressure to the reaction cylinders, said hydraulic circuit including means to deliver substantially the same hydraulic pressure to each of the cylinders, and a common relief valve to protect the cylinders from being overloaded.

14. The mining launch device of claim 13, wherein each reaction cylinder includes a piston rod, and said hydraulic assembly includes a spool valve associated with each cylinder, with each spool valve having a first, a second and a third operative position, with the first position rendering the associated cylinder inoperative, the second position delivering hydraulic fluid under pressure to the associated cylinder to cause telescopic extension between the cylinder and its associated piston rod, and the third position delivering hydraulic fluid to the associated cylinder to cause telescopic retraction between the cylinder and its associated piston rod.

15. The mining launch vehicle of claim 13, wherein said hydraulic assembly includes a check valve associated with each cylinder to relieve pressure therefrom with the common relief valve communicating with the check valves, said hydraulic assembly further including valves to ensure actuation of all the check valves to ensure that they act in unison.

16. An auger mining machine comprising:

a cutter head including a housing, a cutting assembly supported on a leading portion of the housing, said assembly including at least one cutter, means to cause rotation of the cutter, and steering surfaces movable to engage a mine wall to apply a force generally transverse of the direction of movement of the machine along a longitudinal axis, said steering surfaces being located on the housing so as to be spaced from said leading portion and to be closer to a rear portion of said housing; and an auger train extending rearwardly from the cutting head to transport material mined away from the cutting head.

17. The mining machine of claim 16, wherein the cutting assembly includes a pair of cutters which are rotatably driven in opposite directions, by said motor means, about generally parallel axes extending longitudinally of the mining machine.

18. The mining machine of claim 16, wherein the cutting assembly is movably mounted on the housing for relative movement with respect thereto in a direction generally parallel to the longitudinal axis of the mining machine.

19. The mining machine of claim 18, further including at least one auger member mounted within the housing to convey mined material from the cutting assembly, which auger member communicates with the auger train to deliver material thereto.

20. The mining machine of claim 16, wherein said steering surfaces include steering surfaces which guide the mining machine in a generally vertical plane and steering surfaces which provide for lateral control.

21. The mining machine of claim 16, which includes a gyro to aid in the steering.

* * * * *